US009826790B2

(12) United States Patent
Abraham

(10) Patent No.: US 9,826,790 B2
(45) Date of Patent: Nov. 28, 2017

(54) PRE-TIED MULTI-KNOTTED NECKTIE

(71) Applicant: Sammie Abraham, Houston, TX (US)

(72) Inventor: Sammie Abraham, Houston, TX (US)

( * ) Notice: Subject to any disclaimer, the term of this patent is extended or adjusted under 35 U.S.C. 154(b) by 0 days.

(21) Appl. No.: 14/667,662

(22) Filed: Mar. 24, 2015

(65) Prior Publication Data

US 2015/0264989 A1 Sep. 24, 2015

Related U.S. Application Data

(60) Provisional application No. 61/969,670, filed on Mar. 24, 2014.

(51) Int. Cl.
*A41D 25/02* (2006.01)

(52) U.S. Cl.
CPC ..... *A41D 25/02* (2013.01)

(58) Field of Classification Search
CPC ..... A44D 25/00; A44D 25/02; A44D 25/06; A44D 25/025; A44D 25/001; A44D 25/08; A44D 25/10; A44D 27/08; A44C 25/00
USPC ..... 2/144, 148, 149, 152.1
See application file for complete search history.

(56) References Cited

U.S. PATENT DOCUMENTS 1,540,136 A * 6/1925 Laage ..... A41D 25/001 2/144
5,016,285 A * 5/1991 Just ..... A41D 25/00 2/144
5,416,925 A * 5/1995 Davis ..... A41D 25/02 2/144
5,722,095 A * 3/1998 Jonas ..... A41D 25/001 2/144
5,963,987 A * 10/1999 Walls ..... A41D 25/00 2/144
6,076,188 A * 6/2000 Dresen ..... A41D 25/04 2/144
2007/0214543 A1* 9/2007 Yuan ..... A41D 25/00 2/144
2007/0234468 A1* 10/2007 Riley ..... A41D 23/00 2/244
2008/0172772 A1* 7/2008 Kim ..... A41D 25/06 2/144

OTHER PUBLICATIONS https://web.archive.org/web/20061104010924/http://2002ties.com/ties/indexfiles/chrismas.htm, Nov. 4, 2006.*

* cited by examiner

*Primary Examiner* — Gloria Hale
(74) *Attorney, Agent, or Firm* — Karen B. Tripp

(57) ABSTRACT

A pre tied necktie comprising a braided knot. The pre tied necktie is available in a vast array of colors and styles, from conservative solids to more flashy designs that contains dots, stripes or even cartoon characters.

7 Claims, 2 Drawing Sheets

PRE-TIED MULTI-KNOTTED NECKTIE

CLAIM OF PRIORITY

This patent application claims priority under 35 USC 119 (e) (1) from U.S. Provisional Patent Application Ser. No. 61/969,670 filed Mar. 24, 2014, of common inventorship herewith entitled, "Abraham Twist," which is incorporated herein by reference as though the same were set forth in its entirety.

FIELD OF THE INVENTION

The present invention pertains to the field of clothing, and more specifically to the field of neckties.

BACKGROUND OF THE INVENTION

The prior art has put forth several designs for neckties. Among these are:

U.S. Pat. No. 6,076,188 to Birgit Dresen and Gernot Lenz describes a necktie made of leather, textiles or flexible material with a collar for fastening the tie around a neck. A front apron is fitted to the collar, whereby the front apron is made of at least three braided bands.

U.S. Pat. No. 2004/0017085 to David Daniels describes a decorative necktie knot device that replaces the need for a necktie knot altogether. The decorative necktie knot consists of a one piece continuous body having a pair of slots for receiving the bottom portions of a conventional necktie knot. The decorative necktie knot has a generally triangularly shaped front face with side panels. The right side panel and left side panel fold upon one another to form a cavity to receive the necktie. Attached to the side panels are fastening means to secure and define the shape and cavity. A single opening at the bottom of the front face permits the traditional necktie to emerge from the decorative necktie knot.

U.S. Pat. No. 5,010,593 to Carl T. Stevens describes a decorative necktie knot cover that is adapted to be easily placed encompassing a necktie knot and removal therefrom. The decorative cover has a generally triangularly shaped front face with side panels on two of the three sides. The side panels have attached protruding tabs, and a top panel and rear panel. The front side, side panels, top panel and rear panel are folded to form a cavity receiving the necktie knot. Attached to the protruding tabs and to the rear panel are fastening means. These rear panel fastening means are adapted to receive the protruding tabs fastening means to secure and define the cavity. In an alternate embodiment, the fastening means are attached only to the protruding tabs so they connect with each other behind the rear panel. The top panel attached to the top of the triangular face is so shaped to allow an opening on opposite sides to receive the necktie as it surrounds the person's neck. A single bottom opening at the bottom of the front face permits the tie to emerge from the decorative cover. The necktie knot cover is secured about the knot until removal is desired.

None of these prior art references describe the present invention.

SUMMARY OF THE INVENTION

It is an object of the present invention to provide a line of pre tied neckties with a distinctive braided knot.

DETAILED DESCRIPTION OF THE INVENTION

Wearing ties is very ancient custom that disappeared for centuries and returned to become a mainstay of men's suited attire in western civilization. Many suits currently presented by important designers are accompanied with ties to complement the attire of a modern and elegant man. An elegant accessory, neckties are popular because they are one of the few fashion accessories men have to express their imagination, personality and even sense of humor. There will always be circumstances, roles, professions and occasions demanding ties such as business meetings and formal occasions.

The present invention, hereinafter referred to as the Abraham Twist Necktie, or simply Abraham Twist, is a line of pre tied neckties with a distinctive braided knot. The Abraham Twist provides a fashionable new update to the standard necktie look. Fabricated of materials ranging from woven silk to cotton fabric, the Abraham Twist tie is made from the same materials common to standard fashion neckties. Unique to this product and what sets it apart from common tie varieties is found in its knot's appearance. Unlike the standard tying formations, including the frequently used four in hand method and the half Windsor knot which comprises a single horizontal level at the nape of the neck, the Abraham Twist has an aesthetically pleasing knot which is formed by crisscrossing the tie material into a plait similar in appearance to braided hair. The Abraham Twist is pre tied into a knot that consists of a series of diagonal layers, one on top of the other. Ties with the Abraham Twist are available in a vast array of colors and styles, from conservative solids to more flashy designs that contains dots, stripes or even cartoon characters.

Figure 1:
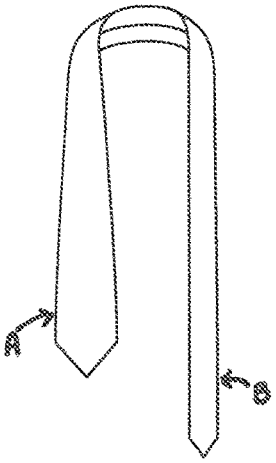
FIGS. 1 through 15 are step by step illustrations showing how to tie one version of a braided knot suitable for use in the present invention.
Figure 2:
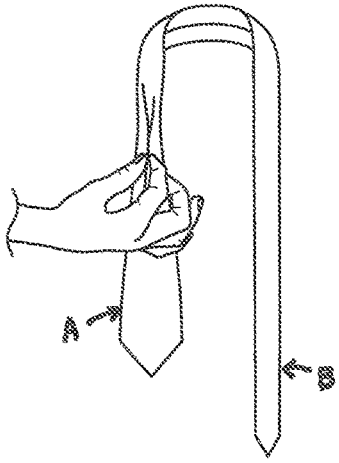
Figure 3:
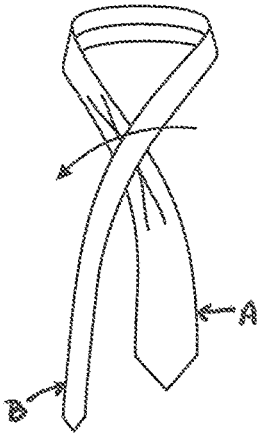
Figure 4:
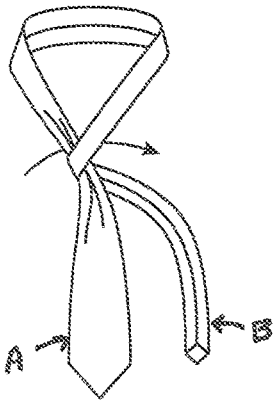
Figure 5:
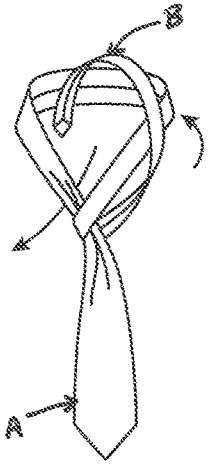
Figure 6:
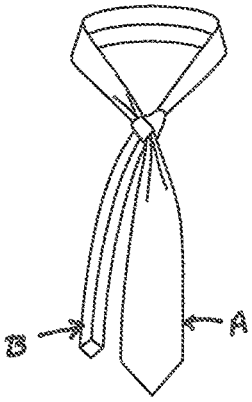
Figure 7:
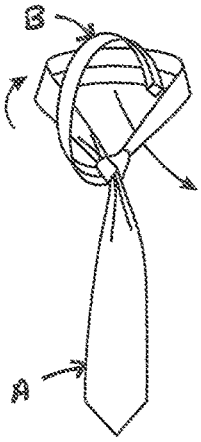
Figure 8:
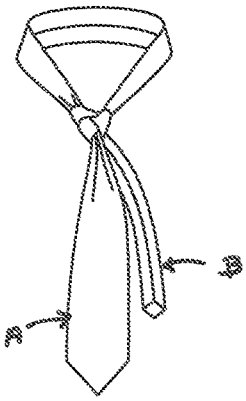
Figure 9:
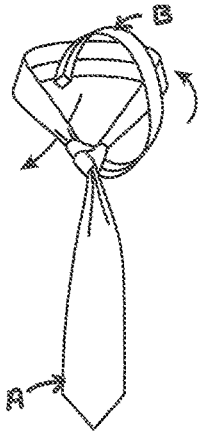
Figure 10:
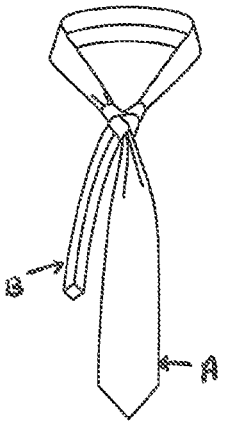
Figure 11:
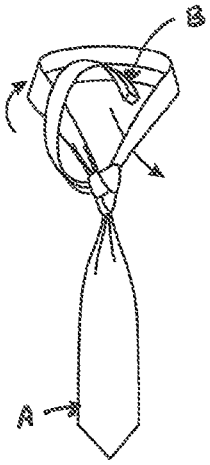
Figure 12:
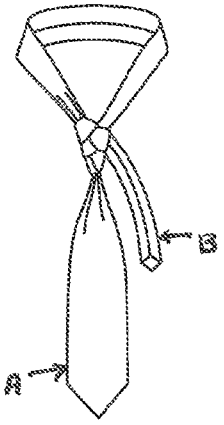
Figure 13:
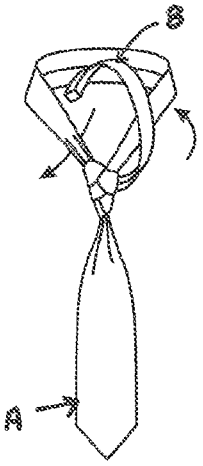
Figure 14:
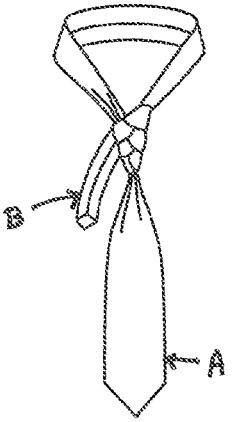
Figure 15:
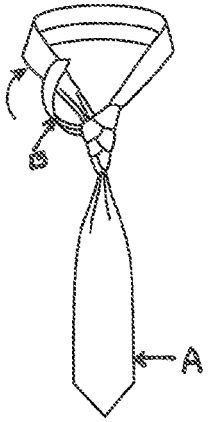
Figure 16:
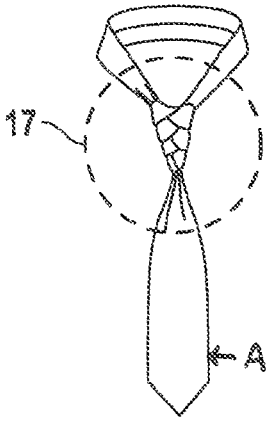
FIG. 16 is an illustrative prototypical front view showing a braided knot on a pre tied tie.
Figure 17:
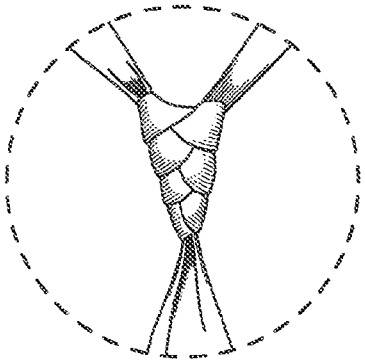
FIG. 17 is a prototypical close up view showing a braided knot on a pre tied tie.

One version of the Abraham Twist can comprise a braided knot made according to the steps illustrated in FIGS. 1 through 17. Please refer to these figures. The knot tied herein requires two loose ends, labeled "A" and "B". For purposes of this instruction, ends "A" and "B" are shown in different shades. To make this knot, follow these instructions:

With end "B", make a loop around end "A", going under and then around over the top and down, as shown in FIGS. 3-6. Then loop end "A" around end "B", and bring it down under itself, through the end "B" loop. Tighten both loops, shown in FIG. 4. Bring end "B" under end "A" around the top of the knot, and the end "A" loop. End "A" loop will require slight loosening. Tighten end "B" loop, shown in FIG. 6. There will now be two loops from end "B" going into the knot. Turn the entire knot over so that end "A" is now on the right. Bring end "A" under end "B", around and down through the second end "B" loop. Tighten the knot, as shown in FIG. 8. Continue turning the knot over and bringing the end on the right under the end on the left, around and down through the bottom loop. Repeat until the desired length of knot is achieved.

Using the Abraham Twist is very simple and straightforward. The user selects a style according to what best matches their dress apparel or to simply make a bold fashion statement. A business executive may choose a charcoal gray Abraham Twist tie to accentuate his new sport coat. A person attending a holiday party may opt for an Abraham Twist tie emblazoned with a seasonal character such as smiling Santa faces. As the Abraham Twist is already knotted in its braided form when sold, a user simply slips the looped opening over his head, and places the material around and underneath their shirt collar. Pushing up the Abraham Twist knot so that it is secure yet comfortable, the user has completed the tie regimen. With the Abraham Twist so easily donned, the user sports a look that is professional, dressy and eye catching.

The Abraham Twist provides consumers with a unique new fashion accessory. Updating the standard necktie design by introducing a braided knot, the Abraham Twist tie has a more intricate appearance. Users add excitement and pizzazz to their wardrobes while also expressing individuality through fashion. As dressy as standard neckties, the Abraham Twist allows consumers to present an impeccable, attractive and professional appearance at all times. With its pre tied fabrication, the present invention product is applied and removed in a matter of seconds. Fabricated of durable and high quality materials, an Abraham Twist necktie will withstand years of continued use.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

What is claimed is:

1. A pre tied necktie with a braided necktie knot comprising: a necktie of standard length having two ends wherein one end is labeled "A" and one end is labeled "B"; wherein first, a braided knot is formed with the necktie length by grasping end "B" and then looping the end "B" around the end "A" wherein end "B" extends under and then around and over a top of end "A" and then downward, wherein end "A" is then looped around end "B" and end "A" is then brought down under itself, through the end "B" loop with both of the loops then tightened; second, end "B" is brought under end "A" around a top of the knot, and the end "A" loop; thirdly, end "A" loop is slightly loosened and end "B" loop is tightened; thereby providing two loops from end "B" included in the knot wherein the first through third steps are repeated to achieve a desired tie length.

2. The necktie length of the pre tied necktie of claim 1, wherein the necktie is made of cotton.

3. The necktie length of the pre tied necktie of claim 1 wherein the necktie is made of silk.

4. The pre tied necktie of claim 1, wherein the necktie is constructed of a material selected from materials in a vast array of colors and designs including any of dots, stripes or designs of cartoon characters in a vast array of colors and styles, from conservative solids to more flashy designs that contains dots, stripes or even cartoon characters.

5. The pre tied necktie of claim 1 wherein the first, second and third steps are repeated until end "B" is substantially entirely within the knot:

a braided knot is formed with the necktie length by grasping end "B" and then looping the end "B" around the end "A" wherein end "B" extends under and then around and over a top of end "A" and then downward, wherein end "A" is then looped around end "B" and end "A" is then brought down under itself, through the end "B" loop with both of the loops then tightened;

end "B" is brought under end "A" around a top of the knot, and the end "A" loop; and end "A" loop is slightly loosened and end "B" loop is tightened; wherein two loops from end "B" are included in the knot.

6. A necktie having a pretied braided necktie knot comprising: a necktie of standard length having two ends wherein one end is labeled "A" and one end is labeled "B"; wherein first, a braided knot is formed with the necktie length by grasping end "B" and then looping the end "B" around the end "A" wherein end "B" extends under and then around and over a top of end "A" and then downward, wherein end "A" is then looped around end "B" and end "A" is then brought down under itself, through the end "B" loop with both of the loops then tightened; second, end "B" is brought under end "A" around a top of the knot, and the end "A" loop; thirdly, end "A" loop is slightly loosened and end "B" loop is tightened; thereby providing two loops from end "B" included in the knot wherein the first through third steps are repeated to achieve a desired tie length.

7. A method for tying a necktie with a braided necktie knot, the necktie being of standard length having two ends wherein one end is labeled "A" and one end is labeled "B"; the method comprising the steps of:

first, forming a braided knot with the necktie length by grasping end "B" and then looping the end "B" around the end "A" wherein end "B" extends under and then around and over a top of end "A" and then downward;

second, looping end "A" around end "B", and bringing end "A" down under itself, through the end "B" loop;

third, tightening both loops;

fourth, bringing end "B" under end "A" around a top of the knot, and the end "A" loop;

fifth, slightly loosening end "A" loop and tightening end "B" loop;

lastly, repeating said above first through fifth steps until a desired tie length is achieved.

* * * * *